United States Patent [19]

Lange

[11] Patent Number: 4,639,042

[45] Date of Patent: Jan. 27, 1987

[54] CHAIR BACK ARRANGEMENT

[75] Inventor: Gerd Lange, Kapsweyer, Fed. Rep. of Germany

[73] Assignee: Fixtures Manufacturing Corporation, Kansas City, Mo.

[21] Appl. No.: 736,457

[22] Filed: May 21, 1985

[51] Int. Cl.[4] ..... A47C 3/04

[52] U.S. Cl. ..... 297/444; 297/239; 297/443; 297/445

[58] Field of Search ..... 297/183, 188, 190, 191, 297/444, 443, 450, 239, 451, 281, 445; D6/334, 380

[56] References Cited

U.S. PATENT DOCUMENTS

| | | | |
|---|---|---|---|
| D. 164,291 | 8/1951 | Duer . | |
| 198,369 | 6/1964 | Jakobsen et al. | D6/380 |
| 1,583,217 | 5/1926 | Wurdack | 297/451 |
| 2,709,484 | 5/1955 | Lamb | 297/239 X |
| 3,227,487 | 1/1966 | Blanchard, Jr. et al. . | |
| 3,275,371 | 9/1966 | Rowland . | |
| 3,310,343 | 3/1967 | Schultz . | |
| 3,402,963 | 9/1968 | Fujioka et al. . | |
| 3,677,601 | 7/1972 | Morrison et al. . | |
| 3,708,202 | 1/1973 | Barecki et al. . | |
| 3,722,954 | 3/1973 | Rey et al. . | |
| 3,751,109 | 8/1973 | Dufton . | |
| 3,774,960 | 11/1973 | Blodee | 297/239 |
| 3,847,433 | 11/1974 | Acton et al. . | |
| 4,018,479 | 4/1977 | Ball . | |
| 4,097,089 | 6/1978 | Peterson . | |
| 4,199,189 | 4/1980 | Neumann | 297/445 |
| 4,542,938 | 9/1985 | Tisbo et al. | 297/445 |

FOREIGN PATENT DOCUMENTS

| | | | |
|---|---|---|---|
| 965455 | 9/1950 | France | 297/443 |
| 1034286 | 7/1953 | France | 297/443 |

*Primary Examiner*—Kenneth J. Dorner
*Assistant Examiner*—Laurie K. Cranmer
*Attorney, Agent, or Firm*—Litman, Day and McMahon

[57] ABSTRACT

A chair back arrangement is provided for use on stackable chairs utilized in convention centers, assembly halls, banquet halls and the like. The chair back includes a large ventilation space centrally located in a upper back portion of the chair. Preferably, the ventilation space is provided by utilizing two, independently mounted, laterally spaced back panels to form the chair back. In the preferred embodiment, each chair back panel is generally trapezoidally shaped and is supported on three sides by an appropriately bent tubular member. The chair back comprises two such tubular members which are integral with rear legs of the chair. It is shown that appropriate tubular material can be selected to provide a preferred flexing of the chair back panels.

9 Claims, 7 Drawing Figures

CHAIR BACK ARRANGEMENT

Background of the Invention

The present invention relates to chairs and in particular to stackable chairs, which are commonly used in banquet halls, auditoriums, convention centers and the like. Specifically, the invention relates to the construction and arrangement of backrests, or back portions, of such chairs.

Conventional chairs usually comprise a seat platform supported by chair legs at an appropriate height for use by adults. The seat platform usually has a front edge and a rear edge. A chair back extends generally upwardly from the rear edge of the chair seat. The chair back often slants rearwardly, for the comfort of a person sitting on the chair.

Conventional chair backs are often a single cushion or panel of material which is mounted on a portion of a chair frame located at the rear edge of the seat. In another common type of chair, the chair back and the chair seat form a single, simultaneously molded, piece.

A significant problem with such conventional chair backs is that they do not provide sufficient ventilation whereby air may reach the back of a person sitting in the chair and leaning against the chair back. If the person utilizing the chair remains seated for a significant period of time, as often occurs at assemblies and convention meetings, significant heat may build up between the person's back and the chair, causing discomfort.

In some chairs, certain types of ventilation spaces are provided. For example, many chairs in which the chair back and seat comprise a single molded piece include a ventilation space located in the chair back at a portion corresponding to the lower back region of the person utilizing the chair. Such spaces have significantly aided comfort of persons sitting in the chair, however the central and upper back portions of the chair back still included no ventilation space for comfort.

Similarly, in conventional chairs in which the back comprises a single panel mounted upon a chair frame, a space may be left between the panel and the rear edge of the chair seat, again in the lower back region. Such construction suffers the same problem of no ventilation in the central and upper back region, as discussed above.

With conventional chair back configurations, merely increasing the number of, or size of, ventilation spaces in the back of the chair is not a fully acceptable solution. First, with most chair back designs, increasing the size of the ventilation spaces weakens the structural strength of the chair. Further, if the chair back is to be upholstered, applying the upholstery around the spaces may be both difficult and expensive. Also, with conventional chair back construction, it can be expected that the chair back will become uncomfortable to lean against if numerous spaces were provided therein.

In conjunction with providing ventilation in the back of the chair, it is desirable that the selected chair back construction be relatively inexpensive to manufacture and be easy to assemble. While conventional chairs may exhibit these features when ventilation spaces are not provided, or where only a lower back space is provided, these capabilities generally might not be satisfactorily achieved where the ventilation spaces are included throughout the central and upper back portion of the chair. As discussed above, this is a particular problem where the back portion is to be upholstered.

Comfort for the back of a person sitting in a chair appears to be dependent upon three primary factors, in addition to ventilation: First, the angle of the back rest with respect to the chair seat; second, the cushion in the back rest; and third, the ability of the back rest to flex somewhat with respect to pressure placed thereagainst. This latter feature is frequently employed in office chairs and the like, which are relatively expensive to produce, but not in chairs intended for use in convention centers or the like, which should be relatively inexpensive, for purchasing in bulk. It is desirable, therefore, to construct a chair back which will flex somewhat with respect to pressure placed thereagainst, so that if a person sits down in it too hard, or stretches while sitting in it, the chair back will not provide a too rigid obstruction. It will be understood that for an upholstered, cushioned, chair, the flexing capability of the chair back need be only very slight in order to be significant.

OBJECTS OF THE INVENTION

Therefore, the objects of the present invention are: to provide a chair having a chair back arrangement especially suited for stackable chairs used in convention centers, banquet halls, conference rooms and the like; to provide such a chair back which includes ventilation means in a central portion thereof; to provide such a chair back which comprises individual back panel portions, mounted upon a chair frame, and having a ventilation space therebetween; to provide such a chair back having chair back panels in cooperation with frame members which have a slight propensity to flex as significant pressure is placed thereagainst; to provide such a chair back in which the chair back panels may be cushioned and upholstered; to provide such a chair back in which the back panels are particularly adapted for quick mounting and dismounting upon the chair frame; to provide such a chair back which is particularly adapted for use with stackable chairs; to provide such a chair back which includes two laterally spaced chair back panels; to provide such a chair back which is relatively inexpensive to produce; and, to provide such a chair back which is easy to manufacture, simple to use, and which is particularly well adapted for the proposed usages thereof.

Other objects and advantages of this invention will become apparent from the following description taken in connection with the accompanying drawings which are set forth, by way of illustration and example, certain embodiments of this invention.

SUMMARY OF THE INVENTION

A stackable chair is provided for use in convention halls or similar places where large numbers of relatively inexpensive chairs are frequently needed. The chair is of the stackable type, so that it may be relatively easily shipped or stored. This invention concerns the construction of a new and useful chair back for such chairs.

The chair includes a seating portion mounted on, and supported by, four legs of an appropriate length for comfortably accomodating persons of differing heights. The seating portion has front and rear edges, with the chair back extending generally upwardly from the rear edge. The chair back leans somewhat rearwardly, as it extends upwardly from the seating portion, for the comfort of the user.

The chair back includes frame members and two, laterally spaced, independently mounted, back panels. In the preferred embodiment, the back panels are each of approximately the same size, and each comprises approximately one-half of the back or backrest. Spacing between the two panels provides a central ventilation space extending along and completely through a central portion of the chair back.

In the preferred embodiment, the chair back frame portion includes two substantially vertical members, and a substantially horizontal member. The vertical members are substantially mirror images of one another, each having a back panel mounted thereon. The frame members comprise appropriately bent tubular material, such as a light metal tubing. The generally vertical frame members, in the preferred embodiment, each have a configuration somewhat analogous to a block letter "C", or, more specifically, a configuration outlining a short end and two sides of a trapezoid. Viewing each vertical frame member as comprising three edges, the tubular frame member defines the following: a first central edge corresponding to the short end of a trapezoidal configuration; and upper and lower outwardly extending end portions or extensions corresponding to the side edges of the trapezoid.

The vertical frame members are mounted upon the chair with the frame member central portions extending generally vertically in the center of the chair back. The frame members are spaced apart for ventilation. Also, the frame members are mounted as mirror images of one another with the upper lower end portions extending generally outwardly to the side edges of the chair. The horizontal frame member extends between upper ends of the vertical frame members, adding strength to the structure.

In the preferred embodiment, each back panel is a generally "D" or trapezoidal shaped cushion which is supported on three edges by one of the vertical frame members. A longer, trapezoidal, end of the back panel forms an outside edge of the chair back and is not directly supported by, or outlined by, a frame member. The other three edges of each back panel engage a frame member for support. Each back panel includes a quick latch/release mechanism for ease of assembly of the chair. As described above, a ventilation space is left between the back panels when they are mounted.

In the preferred embodiment, the tubular vertical chair back frame members have a rhomboidal cross section. Such a cross section generally permits a greater propensity to flex or bend into, and out-of, a plane bisecting the acute internal angles of the rhomboid. Thus, each back member is more prone to bending in one direction than another. The back members are mounted on the chair so that the propensity to bend or flex corresponds to the direction against which pressure is placed as a person leans back in the chair. While the flexing may be only very slight, depending upon the strength of the tubular material used, it will generally absorb some shock if a person sits down and leans back adruptly, thus promoting comfort and reducing stress on the chair frame. Preferably, the two back panels are mounted so that they, if flexture were exaggerated, would swing open in a "saloon door" fashion, as pressure is placed thereagainst. To some extent, the ability to flex permits the use of less padding or cushioning in the chair back, causing less expense and longer life while providing equivalent comfort.

Also, in the preferred embodiment, the chair back vertical frame members are integral with the rear legs of the chair. This facilitates ease of construction and structural integrity of the chair.

Other advantages generated from the above described chair back construction include: that a large, lower back ventilation space is left in a central portion of the chair back as a result of the configuration of the vertical frame members; that the chair back is attractive in appearance; that the chair back panels may be upholstered without significantly affecting the ease of construction of the chair; that a central ventilation space is achieved relatively easily and inexpensively; that no construction features are present which significantly inhibit the ability of the chairs to be stacked; that the horizontal frame member provides a handle by which the chairs may be easily lifted or moved; that the chair back panels may be easily dismounted for cleaning or replacing; and, that the necessary bends in the tubular vertical frame members are relatively easy to make.

The drawings constitute a part of this specification and include exemplary embodiments of the present invention and also illustrate various objects and features thereof.

Figure 1:
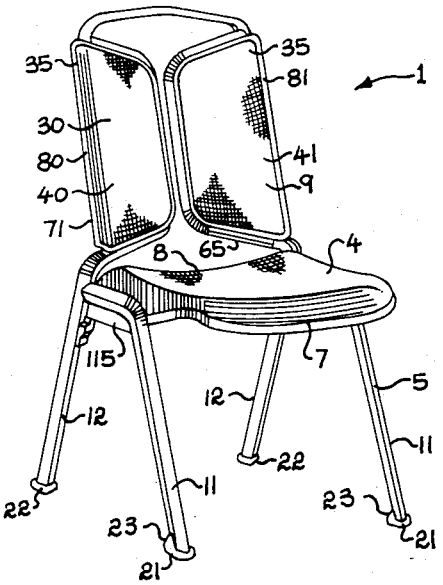
FIG. 1 is a front perspective view of a stackable chair including a chair back according to the present invention.

It will be understood that in certain instances relative thickness of materials may be shown exaggerated, for clarity.

DETAILED DESCRIPTION OF THE PREFERRED EMBODIMENT

As required, detailed embodiments of the present invention are disclosed herein; however it is to be understood that the disclosed embodiments are merely exemplary of the invention which may be embodied in various forms. Therefore, specific and structural details disclosed herein are not to be interpreted as limiting, but rather merely a basis for the claims and as a representative basis for teaching one skilled in the art to variously employ the present invention in virtually any appropriately detailed structure.

The reference numeral 1 generally designates a stackable chair according to the present invention. Referring to the front and rear views of FIGS. 1 and 2, the chair 1 includes a seat 4 supported by support means 5, at an appropriate height for use by a person desiring to sit on the chair. The seat 4 includes a front edge 7 and a rear edge 8. A chair back 9 extends generally upwardly from the rear edge 8. As seen by reference to FIGS. 1 and 2, the chair back 9 slopes somewhat rearwardly as it extends upwardly, promoting comfort of a person utilizing the chair 1.

Figure 3:
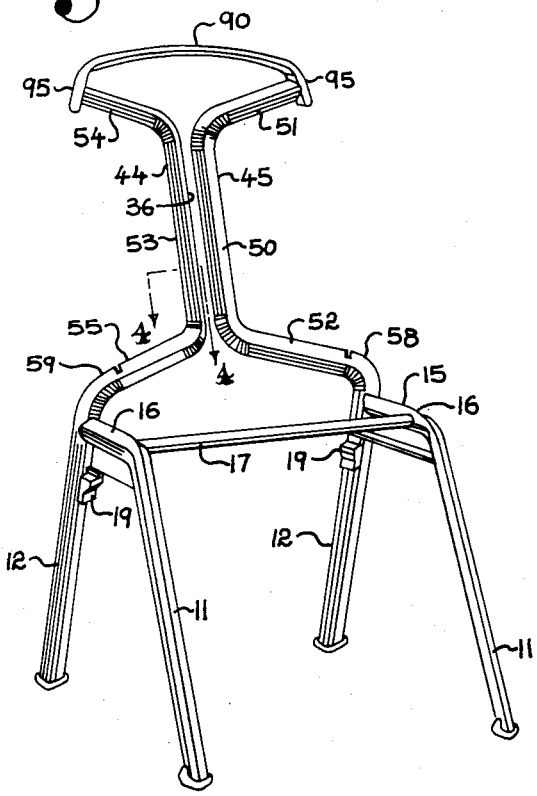
FIG. 3 is an enlarged, front perspective view of a frame of the chair shown in FIG. 1.

While a variety of support means 5 may be utilized to support the seat 4, in the preferred embodiment, the support means 5 comprises two front legs 11 and two rear legs 12, appropriately positioned to sturdily support the seat 4. Referring to FIG. 3, which shows a chair frame 15 of the chair 1, the front legs 11 are mounted upon the rear legs 12 by lateral extension members 16. In the preferred embodiment, the extension members 16 are integral with the front legs 11 and are mounted upon the rear legs 12 as by welding. Preferably, the front and rear legs, 11 and 12 respectively, are constructed from a tubular material of appropriate strength, such as a light metal. The lateral extension members 16 comprise end portions of the front legs 11 which extend beyond bends in the tubing.

Central cross member 17 is mounted upon, and extends between, the lateral extension members 16 to strengthen the chair 1 and to aid in support of the seat 4.

The chair according to the preferred embodiment is stackable; that is, a first chair may be nested with a second chair, or stacked thereon, for ease of storage, shipment and handling. Stacking blocks 19, FIG. 3, mounted on the rear legs 12 facilitate stacking with reduced likelihood of injury to a chair upon which the stacking takes place.

Figure 2:
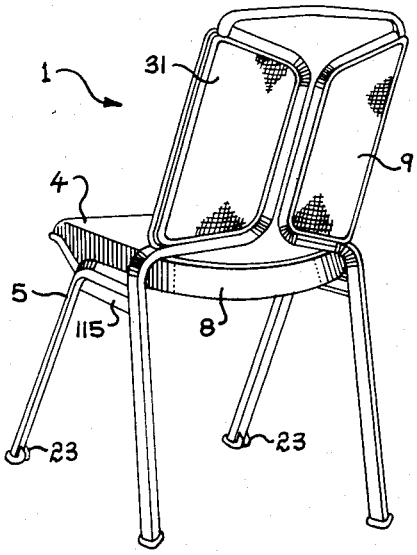
FIG. 2 is a rear perspective view of the chair shown in FIG. 1.

Front glides 21 and rear glides 22, FIGS. 1 and 2, protect the floor from the lower ends of the legs 11 and 12. The glides 21 on the front legs 11 preferably include upwardly extending glide extensions 23 which protect the chairs during stacking.

Referring again to FIGS. 1 and 2, the chair back 9 includes a front side 30 and a rear side 31. The front side 30 faces generally toward the chair seat 4 and is the side of the chair back 9 against which a person, utilizing the chair, leans.

According to the present invention, the chair back 9 comprises a plurality of individual back panels 35 mounted upon the frame 15. The back panels 35 are mounted laterally spaced, leaving a ventilation space 36, FIG. 7, therebetween. In the preferred embodiment, the chair back 9 includes first and second side panels 40 and 41, which are substantially mirror images of one another, each of which forms approximately one-half of the chair back 9. Referring to FIG. 3, interpreted with respect to FIG. 1, the chair back 9 includes two substantially vertical extensions or frame members 44 and 45, having the ventilation space 36 therebetween. The back panels 40 and 41 are independently mounted on the vertical frame members 44 and 45, with back panel 40 mounted upon frame member 44, and back member 41 mounted upon frame member 45. This is also understood by reference to FIG. 7.

In the preferred embodiment, the chair back vertical frame members 44 and 45 are mounted substantially as mirror images of one another, each having a configuration somewhat similar to a block letter "C", or, more specifically, each being bent into a configuration outlining three sides of a trapezoid, in particular two equivalent side edges and a short end edge of a trapezoid. Referring to FIG. 3, for vertical frame member 45 the central or vertical portion is designated 50, an upper end portion or lateral extension is designated 51, and a lower end portion or lateral extension is designated 52. Simarlarly, vertical frame member 44 includes central vertical portion 53, upper end portion or lateral extension 54, and lower end portion or lateral extension 55. Ends 58 and 59, of lower portions of side extensions 52 and 55 respectively, engage the remainder of the chair frame 15 for mounting of the vertical frame members 44 and 45 in the chair 1. Preferably, as with a trapezoid, the internal angle between central extension 50 and lower extension 52, is greater than ninety degrees. As is understood by reference to FIG. 1, this results in a large ventilation space 65, in the lower back region of the chair back 9, between the chair back 9 and the chair seat 4, for comfort of persons utilizing the chair. Generally, large open spaces in this portion of chairs are preferred.

As will be understood by reference to the drawings and the following description, preferably the internal angle between central portion 50 and upper portion or side extension 51 is substantially identical to the angle described above for the central portion and the lower side extension. This not only creates attractiveness from overall symmetry, but also ease of construction during formation of the frame member 45 and its associated side panel 41. Frame member 44 is preferably a mirror image of frame member 45 with analogous angles and portions.

Figure 5:
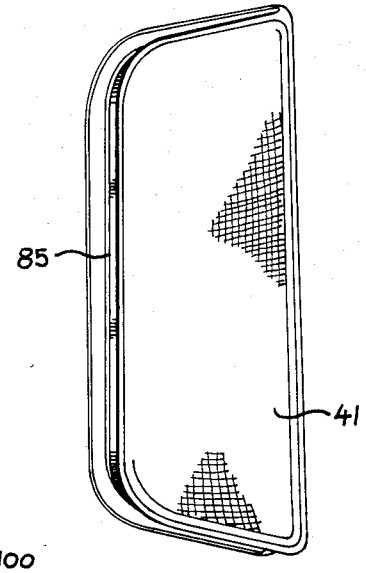
FIG. 5 is an enlarged front view of a chair back panel which is mounted upon the chair frame of FIG. 3, in constructing the chair back illustrated in FIGS. 1 and 2.
Figure 6:
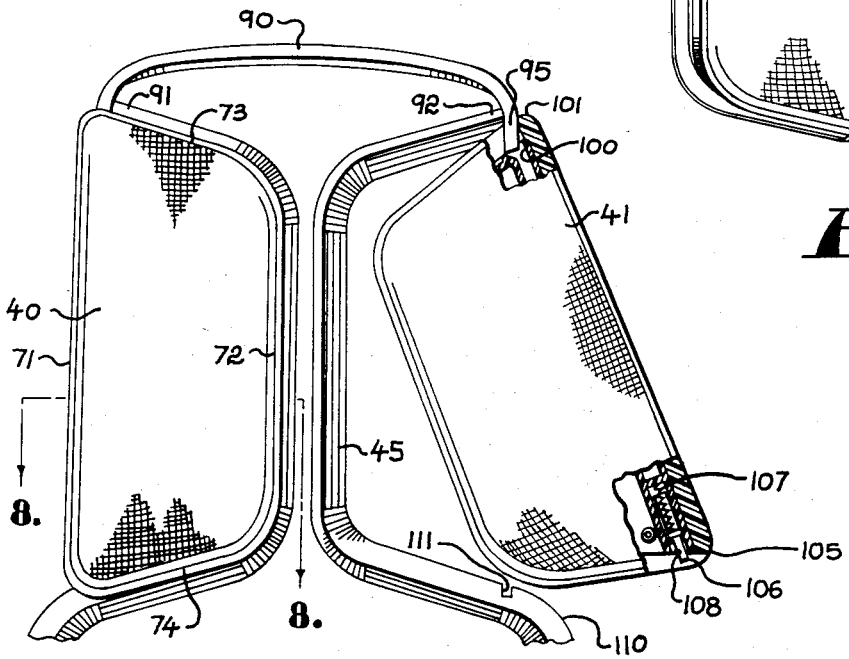
FIG. 6 is an enlarged fragmentary, front elevational view of the chair shown in FIG. 1, with one of the back panels shown during a process of mounting, and with portions broken away to show internal detail.
Figure 7:
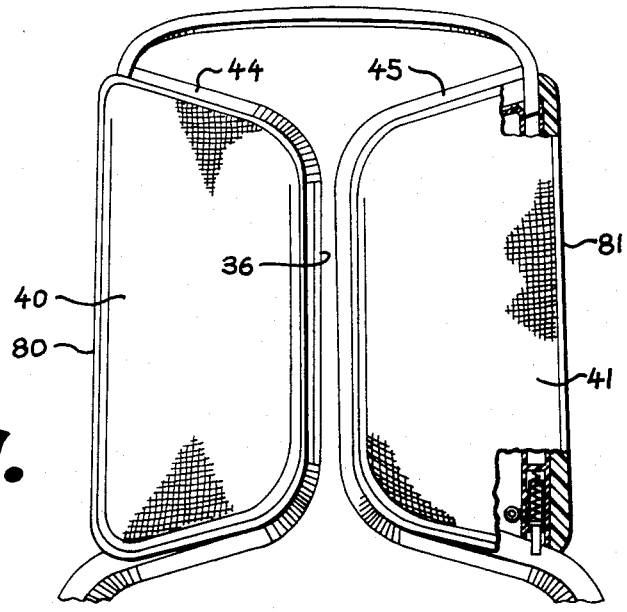
FIG. 7 is an enlarged, fragmentary, front elevational view of the chair shown in FIG. 1 and with portions broken away to show internal detail.

Referring to FIGS. 5, 6, and 7, in the preferred embodiment, the back panels 40 and 41 are generally "D" shaped, or, more specifically, have a generally trapezoidal configuration. Referring to FIG. 6, panel 40 for example, has a long outside edge 71, a shorter, parallel inside edge 72, a first upper side edge 73 and an opposite second lower side edge 74. Referring to FIGS. 5 and 6, the other side panel 41 includes analogous portions and in the preferred embodiment panels 40 and 41 are substantially identical, but mounted as mirror images of each other.

Referring to FIG. 1, the long outside edge 71 of panel 40 comprises an outer side edge 80 of the chair back 9, in the fully assembled chair 1. Similarly, an outer side edge of opposite panel 41 comprises an opposite side edge 81 of the chair back 9.

Referring to FIG. 7, each panel 40 and 41, is supported along three edges by its associated vertical frame member 44 or 45. Thus, each panel is securely held within the chair back 9. Referring to FIGS. 5 and 7 each panel 40 or 41 is shown having a mounting channel 85 extending along, and in, the three edges which will engage the frame member 44 or 45. Since the frame members 44 and 45 extend through the gulleys 85, the back panels 40 and 41 are securely supported.

It will be understood that a variety of means may be utilized to physically secure the panels 40 and 41 to the frame members 44 and 45, in order to ensure that the appropriate portion of the frame members 44 and 45 remain within the channels 85. Preferably, a quick latch and release mechanism, as described below, is used to facilitate assembly.

In the preferred embodiment, FIGS. 1 and 2, the back panels 40 and 41 are angled so that a central portion of the chair back 9 is depressed somewhat, for comfort. This is controlled by the configuration of the frame members 44 and 45.

Referring to FIG. 6, the chair back 9 includes an upper generally horizontal frame member or top rail 90. The horizontal frame member 90 is mounted on, and extends between, upper ends 91 and 92 of the frame members 44 and 45 respectively. Referring to FIG. 3, the horizontal frame member 90 provides for structural integrity and strength in the chair frame 15 and includes downwardly projecting ends 95, which facilitate mounting of the side panels 40 and 41 as described below. Preferably, the horizontal frame member 90 is mounted on the frame members 44 and 45 as by welding.

A preferred method of mounting the panels 40 and 41 upon the chair frame 15 is understood by reference to FIGS. 6 and 7. Each panel, for example panel 41 illustrated in Fig. 6, includes a receiving space 100 substantially near an upper outside corner 101 thereof. A first step of mounting is shown in FIG. 6, wherein a downwardly turned end 95 of the horizontal frame member 90 is inserted into the receiving space 100. An advantage to this method of mounting is that the panel 41 covers up the end of the horizontal member 90, avoiding a sharp end which could injure a user or become caught on a user's clothing. Also, the downwardly turned end 95 provides for secure engagement when inserted in the receiving space 100.

The lower outside corner 105 of panel 41 includes a spring loaded pin 106 mounted therein. The spring 107 permits the pin 106 to be retracted within receiving space 108 in response to pressure. Referring to FIGS. 6 and 7, a shoulder portion 110 in the frame 15, where the chair back frame member 45 is attached to the rear leg 12, is engaged by the pin 106 during mounting, pressing the pin 106 into the receiving space 108. However, when pin receiving channel 111 is encountered, the pin 106 is forced outwardly by the spring 107, locking the panel in place, FIG. 7. The back panel 41 may be readily dismounted by pressing a relatively thin object or blade, between the panel and the frame member 45 in an appropriate manner to engage the pin 106 and cause it to retract. The left panel 40 will be understood to be similarly mounted and dismounted.

Figure 4:
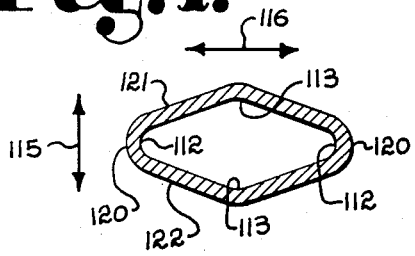
FIG. 4 is a top cross-sectional view showing a portion of the chair frame and taken generally along line 4—4 of FIG. 3.

Preferably, vertical frame members 44 and 45 are tubular, and formed from a sufficiently strong material, such as light metal, for the use intended. Many tubular materials may be bent to form the requisite angles in the chair back vertical frame members. Preferably, the tubular material utilized for frame members 44 and 45 has a rhomboidal cross section, FIG. 4. Referring to FIG. 4, such a tube has two, opposite, acute internal angles 112 and two, opposite, obtuse angles 113. It will be readily understood that such a rhomboidal material has a substantially greater propensity to flex in the directions of double headed arrow 115, FIG. 4, than it has toward flexing in the directions of double headed arrow 116. Referring to FIGS. 1 and 7, this propensity to flex generates a panel flex means which permits the back panels 40 and 41 to independently yield somewhat in response to pressure placed against the front side 30 of the chair back 9 by a person sitting in a chair 1. It will be understood that this ability to flex need not be very great to be significant, since its purpose is to help absorb the shock throughout the frame 15 of the chair, in order to aid comfort and reduce stress to the chair frame 15. Even a minor ability to flex will be significantly advantageous over conventional chair back arrangements, in which there is virtually no such flexing. The rhomboidal cross section of the vertical frame member 44 and 45 significantly enhances this advantage by directing the orientation of any flexing.

Referring to FIG. 3, preferably each vertical frame member 44 and 45 is integral with an associated rear leg 12. In the preferred embodiment each vertical frame member and an associated leg are formed from a single piece of tubular material appropriately bent for use in the chair frame 15. The major point of stress to flexing of the chair back panels 40 and 41, relative to the remainder of the chair 1, and in particular chair seat 4, occurs at the ends 58 and 59 of the lower portions 52 and 55 of the frame members 45 and 44.

The forces directing flexing, while relatively complex, primarily involve two components. First, a flexing of the entire chair back 9 relative to the chair seat 4 in a direction more or less straight back; and secondly, a flexing of the two panels 40 and 41 with respect to one another, which if exaggerated is understood to be similar to a "saloon door" arrangement, wherein the panels swing open and somewhat apart from one another.

The chair back panels 40 and 41 may each comprise a fabric-covered, suitably cushioned, device. Similarly, the chair seat 4 may be fabric covered and cushioned. A variety of fabics and cushions may be selected depending on the desired appearance, desired product lifetime, availability of materials and desired comfort.

Referring to FIGS. 1 and 2, decorative side panels 115 extend between the front and rear legs 11 and 12 for the purpose of keeping certain portions of the chair 1 from view.

The particular advantages of the chair back arrangement according to the present invention, are readily understood by reference to the above descriptions and the drawings. First a central ventilation space 36 is provided between laterally spaced sections, comprising panels 40 and 41 of the chair back 9, creating comfort for persons sitting in a chair 1. The construction arrangement which provides this ventilation space 36 also provides the relatively large ventilation space 65 in the lower back region. The ventilation space 36 is readily provided in a chair which has fabric-coated, cushioned, back panels 40 and 41, with relative ease of manufacture, and without a complicated arrangement which might interfere with the ability of the chair 1 to be stacked.

The rhomboidal cross section, FIG. 4, of the chair back frame members 44 and 45 is also advantageous. First, the rhomboidal arrangement includes a relatively sharp or acute portion 120, FIG. 4, which is readily received within the channel 85 of the back panels 40 and 41 for secure engagement between the back panels 40 and 41 and the frame members 44 and 45 respectively. This secure arrangement is enhanced by the rather flat sides 121 and 122, FIG. 4, on opposite sides of the acute portion 120 which provide for a relatively large area of engagement between each vertical frame member 44 and 45 and its associated back panel 40 and 41.

Also, the rhomboidal cross section provides a direction of relative ease of flexing and a direction which is relatively rigid with respect to flexing. As described above, this permits the chair back 9 to have a propensity to flex in a desired direction, while at the same time being relatively strong and rigid with respect to pressure from certain other directions.

It is readily seen that all of the above advantages are accomodated by a chair back construction which is relatively simple and inexpensive to produce. Further, in the preferred embodiment, the vertical frame members of the chair back 9 are integral with rear legs 12 of the chair. Thus a rear leg and vertical frame member may be constructed from a single piece of tubular material, with overall structural integrity and ease of manufacture.

Further, it has been shown that a simple latch mechanism may be utilized in connection with the back panels for mounting of the panels upon the chair frame. In particular a spring loaded pin mechanism 106 is described. It is readily seen that the mechanism permits ease of assembly, is kept out of view in the finished item, but allows for relative ease of dissassembly if desired. Thus, the fully constructed chair 1, includes a chair back 9 which may be readily and easily dissassembled for cleaning, maintenance and repair. Further, the above described advantages are provided in a chair back which is readily understood to be relatively inexpensive to make.

It is to be understood while certain embodiments of the present invention have been illustrated and described, it is not to be limited to the specific forms or arrangement of parts herein described and shown.

What is claimed and desired to be secured by Letters Patent is as follows:

1. A chair comprising:

(a) a seat and support means;

(i) said support means orienting said seat for engagement by a person sitting on said chair;

(b) a chair back including a front side and having a frame and back panel means;

(i) said chair back having an upper edge, first and second outer side edges and a center portion;

(ii) said chair back frame including a first extension member and a second extension member;

(iii) said first extension member having an upper lateral extension, a lower lateral extension and a central, substantially vertical, portion; said first extension member being mounted in said chair, to form a portion thereof, by said first extension member lower lateral extension;

(iv) said second extension member having an upper lateral extension, a lower lateral extension and a central, substantially vertical, portion; and said second extension member being mounted in said chair, to form a portion thereof, by said second extension member lower lateral extension;

(c) said first extension member central, substantially vertical, portion being aligned with and laterally spaced from said second extension member central, substantially vertical, portion, forming a ventilation space between said first and second extension members and positioned in said center portion of said chair back;

(d) said back panel means including first and second laterally spaced back panels;

(i) said first panel being trapezoid-like in configuration and having: front and back sides; an inner edge; a longer, outer edge; and, first and second opposite and substantially equivalent side edges;

(ii) said first extension member having said first panel mounted thereon: with said first extension member central, substantially vertical, portion engaging said first panel inner edge; with said first extension member upper lateral extension engaging said first panel first side edge; and, with said first extension member lower lateral extension engaging said first panel second side edge;

(iii) said first panel outer edge forming a side edge of said chair back;

(iv) said second panel being trapezoid-like in configuration and having: front and back sides; an inner edge; a longer, outer edge; and, first and second opposite and substantially equivalent side edges;

(v) said second extension member having said second panel mounted thereon: with said second exteions member central, substantially vertical, portion engaging said second panel inner edge; with said second extension member upper lateral extension engaging said second panel first side edge; and, with said second extension member lower lateral extension engaging said second panel second side edge;

(vi) said second panel outer edge forming a side edge of said chair back;

(vii) said second panel inner edge extending generally along and spaced apart from said first panel inner edge, forming a ventilation space therebetween; and (e) said first and second panels having a space therebetween and cooperating to form said chair back, against which a person sitting in said chair may lean, said space between said first and second panels corresponding to said ventilation space;

(f) whereby said chair back has a centrally positioned ventilation space therein for facilitating comfort of a person sitting in said chair; and (g) whereby each of said panels is securely mounted within said chair by each one of said extension members engaging three sides of one of said panels.

2. A chair according to claim 1 including:

(a) first latch/unlatch means for mounting said first panel on said first extension member; and (b) second latch/unlatch means for mounting said second panel on said second extension member.

3. A chair comprising:

(a) a seat and support means;

(i) said support means orienting said seat for engagement by a person sitting on said chair;

(b) a chair back including a front side and having a frame and back panel means;

(i) said chair back having first and second outer side edges and a center portion;

(ii) said chair back frame including a first extension member and a second extension member;

(iii) said first extension member having an upper, outwardly extending, lateral extension, a lower, outwardly extending, lateral extension and a central substantially vertical portion; said first extension member being mounted in said chair, to form a portion thereof, by said first extension member lower, outwardly extending, lateral extension;

(iv) said second extension member having an upper, outwardly extending, lateral extension, a lower, outwardly extending, lateral extension and a central substantially vertical portion; said second extension member being mounted in said chair, to form a portion thereof, by said second extension member lower, outwardly extending lateral extension;

(c) said first extension member central portion being aligned with and laterally spaced from said second extension member central portion, forming a ventilation space between said first and second extension members and positioned in said center Portion of said chair back;

(d) said back panel means including first and second laterally spaced back panels, each of said panels having an outer edge with a mounting channel therein;

(i) said first extension member having said first panel mounted thereon and said second extension member having said second panel mounted thereon; said first extension member engaging said first back panel along an outer edge thereof by means of portions of said first extension member upper lateral extension, lower lateral extension and central vertical portion being received within said channel in said first panel, and said second extension member engaging said second back panel along an outer edge thereof by means of portions of said second extension member upper lateral extension, lower lateral extension and central vertical portion being received within said channel in said second panel;

(ii) said first and second panels having space therebetween said copperating to form said chair back, against which a person sitting in first chair may lean, said space between said first and second panels corresponding to said ventilation space;

(e) first latch/unlatch means for mounting said first panel on said first extension member; and (f) second latch/unlatch means for mounting said second panel on said second extension member;

(g) whereby each of said panels is securely mounted within said chair by one of said extension nembers; and (h) whereby said chair back has a centrally positioned ventilation space therein for facilitating comfort of a person sitting in said chair.

4. A chair comprising:

(a) a seat and support means;

(i) said support means orienting said seat for engagement by a person sitting on said chair; and (b) a chair back including a front side and having a frame and back panel means;

(i) said chair back frame having first flexible frame means and second flexible frame means; said first and second flexible frame means being substantially independently flexible with respect to force directed against said front side of the chair back;

(ii) said back panel means including first and second laterally spaced back panels; said first flexible frame means having said first panel mounted thereon and said second flexible frame means having said second panel thereon; said first and second panels cooperating to form said chair back, against which a person sitting in said chair may lean; said first flexible frame means and second flexible frame means generally facilitating flexing of said first and second panels away from one another, in a saloon door fashion, in response to pressure directed against said chair back;

(c) whereby said first and second panels promote comfort for a person sitting on said chair, by substantially independently, yielding in response to pressure directed against said chair back when said person leans there against; and (d) whereby said laterally spaced back panels form a chair back having a ventilation space therein.

5. A chair according to claim 4 including:

(a) first latch/unlatch means for mounting said first panel on said first flexible frame means; and (b) second latch/unlatch means for mounting said second panel on said second flexible frame means.

6. A chair comprising:

(a) a seat and support means;

(i) said support means orienting said seat for engagement by a person sitting on said chair;

(b) a chair back including a front side and having a frame and back panel means;

(i) said chair back having first and second outer sides and a center portion;

(ii) said chair back frame including a first extension member and a second extension member; said first and second extension members being tubular and each having a generally rhomboidal cross section throughout, with two generally equal and opposite acute inside angles and two generally equal and opposite obtuse inside angles; said extension members being partially flexible, in a direction into and out of a bending plane bisecting said acute angles, and, said extension members being substantially resistant to bending in a plane generally at right angles to said bending plane; said first extension member and said second extension member each being oriented in said chair frame to generally have a greater propensity to flex with respect to pressure directed against said chair back front side than against a side of said chair back; said first extension member and said second extension member each, accordingly, being oriented with an obtuse internal angle directed generally forwardly of said chair;

(iii) said first extension member having: an upper, outwardly extending, lateral extension; a lower, outwardly extending, lateral extension; and, a central, generally vertical, portion; said first extension member being mounted in said chair frame, to form a portion thereof, by said first extension member lower lateral extension;

(iv) said second extension member having: an upper, outwardly extending, lateral extension; a lower, outwardly extending, lateral extension; and, a central, generally vertical, portion; said second extension member being mounted in said chair frame to form a portion thereof, by said second extension member lower lateral extension;

(c) said first extension member central portion being aligned with and laterally spaced from said second extension member central portion, forming a ventilation space between said first and second extension members and positioned in said center portion of said chair back; and (d) said back panel means including first and second laterally spaced back panels, each of said first and second back panels having an outer side edge;

(i) said first extension member having said first panel mounted thereon, with said first panel outer edge engaged by said first extension member upper lateral extension, lower lateral extension and central portion;

(ii) said second extension member having said second panel mounted thereon, with said second panel outer edge engaged by said second extension member upper lateral extension, lower lateral extension and central portion;

(iii) said first and second panels having a space therebetween and cooperating to form said chair back, against which a person sitting in said chair may lean, said space between said first and second panels corresponding to said ventilation space;

(e) whereby said chair back has a centrally positioned ventilation space therein for facilitating comfort of a person sitting in said chair; and (f) whereby said first and second panels further facilitate comfort for a person sitting upon said chair, by indpendently yielding, as necessary, in response to pressure directed against said chair back when said person leans thereagainst; said yielding being partially in a saloon door fashion with said first and second panels opening slightly away from one another; and (g) whereby a direction of flexing of said panels and extension members is in part controlled by said rhomboidal shape of said tubular extension members.

7. A chair according to claim 6 wherein:

(a) said support means comprises first and second front legs and first and second rear legs;

(b) said first extension member upper lateral extension has an outer end and said second extension member upper lateral extension has an outer end;

(c) said chair back includes a top rail means mounted upon, and extending between, said upper lateral extension member outer ends; and wherein (d) said first rear leg is integral with said first extension member and is joined thereto at said first extension member lower lateral extension and, said second rear leg is integral with said second extension member and is joined thereto at said second extension member lower lateral extension.

8. A chair according to claim 7 including:

(a) first latch/unlatch means for mounting said first panel on said first extension member; and (b) second latch/unlatch means for mounting said second panel on said second extension member.

9. A chair comprising:

(a) a seat and support means;

(i) said support means orienting said seat for engagement by a person sitting on said chair;

(b) a chair back including a front side and having a frame and back panel means;

(i) said chair back having first and second outer side edges and a center portion;

(ii) said chair back frame including a first extension member and a second extension member;

(iii) said first extension member having an upper, outwardly extending, lateral extension, a lower, outwardly extending, lateral extension and a central, substantially vertical, portion; said first extension member being mounted in said chair, to form a portion thereof, by said first extension member lower lateral extension;

(iv) said second extension member having an upper, outwardly extending, lateral extension, a lower, outwardly extending, lateral extension and a central, substantially vertical, portion; and said second extension member being mounted in said chair, to form a portion thereof, by said second extension member lower lateral extension;

(c) said first extension member central portion being aligned with and laterally spaced from said second extension member central portion, forming a ventilation space between said first and second extension members and positioned in said center portion of said chair back;

(d) said back panel means including first and second laterally spaced back panels;

(i) said first panel having: front and back sides; an inner edge; and, first and second, opposite, side edges;

(ii) said first extension member having said first panel mounted thereon: with said first extension member central portion engaging said first panel inner edge; with said first extension member upper lateral extension engaging said first panel first side edge; and, with said first extension member lower lateral extension engaging said first panel second side edge;

(iii) said first panel having an outer edge forming a side edge of said chair back;

(iv) said second panel having: front and back sides; an inner edge; and, first and second, opposite, side edges;

(v) said second extension member having said second panel mounted thereon: with said second extension member central portion engaging said second panel inner edge; with said second extension member upper lateral extension engaging said second panel first side edge; and, with said second extension member lower lateral extension engaging said second panel second side edge;

(vi) said second panel having an outer edge forming a side edge of said chair back;

(vii) said second panel inner edge extending generally along and spaced apart from said first panel inner edge, forming a ventilation spaced therebetween; and (e) said first and second panels having a space therebetween and cooperating to form said chair back, against which a person sitting in said chair may lean, said space between said first and second Panels corresponding to said ventilation space;

(f) whereby said chair back has a centrally positioned ventilation space therein for facilitating comfort of a person sitting in said chair; and (g) whereby each of said panels is securely mounted within said chair by each one of said extension members engaging three sides of one of said panels.

* * * * *